US005701702A

United States Patent [19]

Reid et al.

[11] Patent Number: 5,701,702

[45] Date of Patent: Dec. 30, 1997

[54] PET DOOR

[75] Inventors: Alister Peter Reid, London; Christopher Sumner, Merseyside, both of England

[73] Assignee: Reilor Limited, Lancashire

[21] Appl. No.: 622,664

[22] Filed: Mar. 26, 1996

[30] Foreign Application Priority Data

Apr. 6, 1995 [GB] United Kingdom ..... 9507167

[51] Int. Cl.[6] ..... E05D 15/48

[52] U.S. Cl. ..... 49/169; 49/394; 160/180

[58] Field of Search ..... 49/163, 169, 171, 49/394; 160/2, 116, 180, 181; 292/251.5

[56] References Cited

U.S. PATENT DOCUMENTS

| | | |
|---|---|---|
| 4,022,263 | 5/1977 | Beckett et al. . |
| 4,216,743 | 8/1980 | Cohen . |
| 4,969,292 | 11/1990 | Reid et al. . |
| 4,991,350 | 2/1991 | Kirk . |
| 5,469,659 | 11/1995 | Reid et al. . |

FOREIGN PATENT DOCUMENTS

| | | |
|---|---|---|
| 963444 | 7/1964 | United Kingdom . |
| 1567001 | 5/1980 | United Kingdom . |
| 2141479 | 12/1984 | United Kingdom . |
| 2223257 | 4/1990 | United Kingdom . |
| 2236135 | 3/1991 | United Kingdom . |

*Primary Examiner*—Jerry Redman

*Attorney, Agent, or Firm*—Dority & Manning, P.A.

[57] ABSTRACT

A pet door has a frame defining an access aperture with a pivotally-hung aperture-closing flap therein and with a catch to secure the flap against opening in one direction. The catch is supported on a collapsible support, and a pivoted lever is normally positioned to prevent collapse of the support whereby the catch is maintained in a flap-securing position. The lever bears a freely-rotatable elongate magnet which is co-operable with a key magnet on a pet collar, and when the key magnet is presented to the pet door, it attracts the magnet on the lever causing the lever to pivot to a position giving the support freedom to collapse and permitting the catch to be moved from the flap-securing position.

14 Claims, 4 Drawing Sheets

PET DOOR

The present invention relates to an improvement or modification of a pet door disclosed in our EP-A-93 30 9266.6 (EP-A-0601726) and its counterpart U.S. Ser. No. 08/163,664, now U.S. Pat. No. 54 69 659.

A typical, basic pet door comprises a frame defining an opening or portal and a pivoted closure flap, usually top-hung in the opening. Such a pet door when mounted in a door, window or external wall allows a pet to enter or exit a building at will, by pushing aside the flap. Regrettably unwanted animals can also enter the building through such a pet door.

To guard against unwanted animals, e.g. stray cats, entering a building, so-called selective pet doors have been developed. Selective pet doors have a latch which secures the flap against opening in at least the in direction, and means to retract the latch freeing the flap when the owner's pet approaches the pet door.

One such pet door, our Staywell (RTM) No. 21 pet door, embodies a sophisticated electronic circuit to control a solenoid for retracting the latch itself. This system is disclosed in our GB patent No. 2 119 431.

Another pet door, which will only allow passage of a pet wearing a key collar, is magnetically-activated. This selective pet door distinguishes between a pet wearing a collar bearing a key magnet from an animal bearing no such key magnet. This system is disclosed in GB patent No. 1 588 673.

The foregoing selective pet doors are relatively costly and they need a source of electrical energy, which can be inconvenient.

A desirable pet door will reliably discern between animals to be admitted and animals to be barred and will react accordingly, while requiring no form of electrical energy to function. Our EP-A-93 30 9266.6 discloses a pet door meeting these desires.

A latchable pet door has been proposed comprising a magnetic cum mechanical latch contrivance which reacts to a pet bearing a key collar, the key of which is a small magnet. The latch comprises a simple, pivoted lever resembling a see-saw. At one end there is a catch normally engageable with the flap, to prevent it being opened in one direction. At the other end the lever mounts a magnet. The weight of the magnet ensures the catch is in a position to engage the flap. The catch is to be retracted away from the flap, releasing the latter, when a cat bearing a collar key magnet attempts to pass through the door. The key magnet attracts the lever magnet and should thereby displace the lever about its pivot, retracting the catch from the flap. This arrangement is disclosed in GB patent No. 1 567 001.

Simple though the principle of this see-saw latch arrangement is, we have found it virtually impossible in practice to make it work reliably and to manufacture it economically. The various practical problems we experienced when endeavouring to put the arrangement of GB patent No. 1 567 001 into practice are related in EP-A-93 30 9266.6, to which reference is directed for details.

After much experiment, we found it possible to develop a latch arrangement which utilises simple magnetic means to permit reliable releasing of the pet door latch. Whilst our arrangement, as disclosed in EP-A-93 30 9266.6, has a magnet-bearing see-saw lever, it is not employed as the flap-engaging catch per se. Rather, it is used to control a separate latch. Normally, the lever retains the latch in a flap-securing position. When, however, a collar magnet interacts with the lever magnet, the lever indirectly frees the latch enabling it to be displaced to a flap-releasing position. Then the latch employed is displaceable from the flap-securing position when a pet wearing a collar magnet pushes against the flap. The preferred latch itself is closely similar to the arrangement disclosed in our GB patent No. 2 141 479, the contents of which are incorporated herein by this reference.

The arrangement disclosed in EP-A-93 30 9266.6 (and U.S. Ser. No. 08/163,664 is depicted in FIGS. 1 to 10 of the accompanying drawings, in which.

Figure 3:
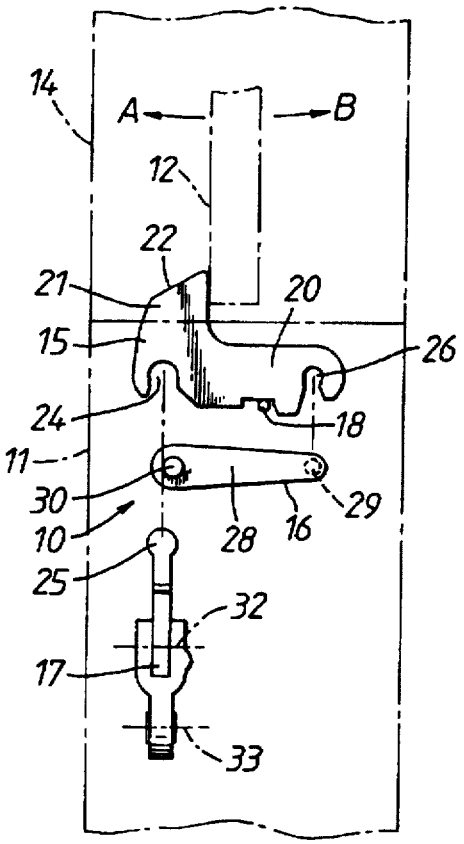
Figure 4:
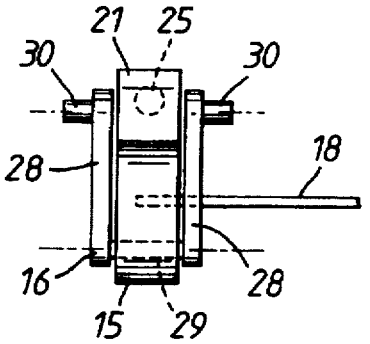
Figure 5:
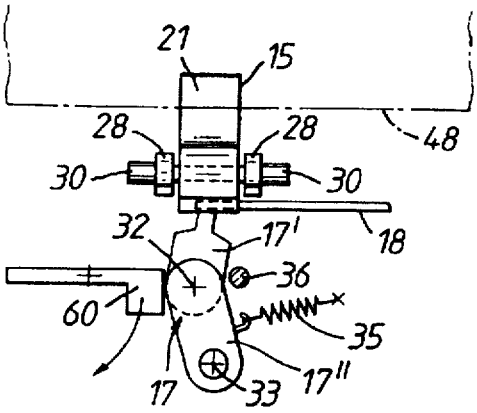
Figure 6:
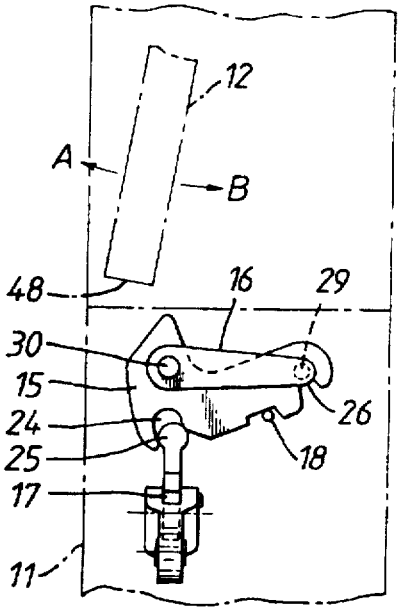
Figure 7:
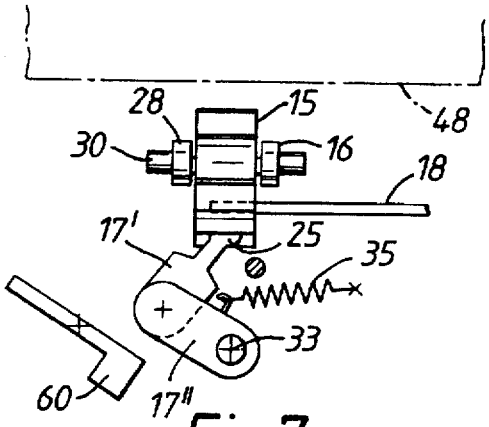
Figure 8:
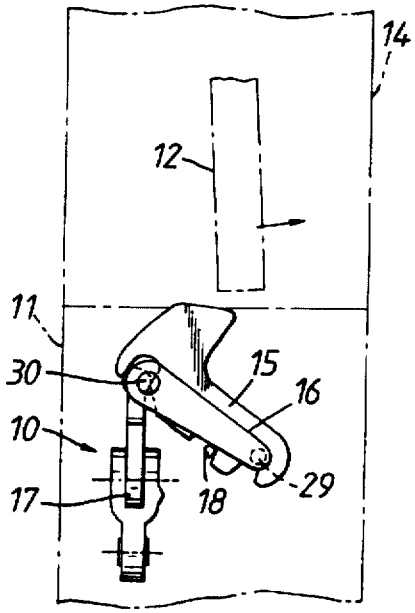
Figure 9:
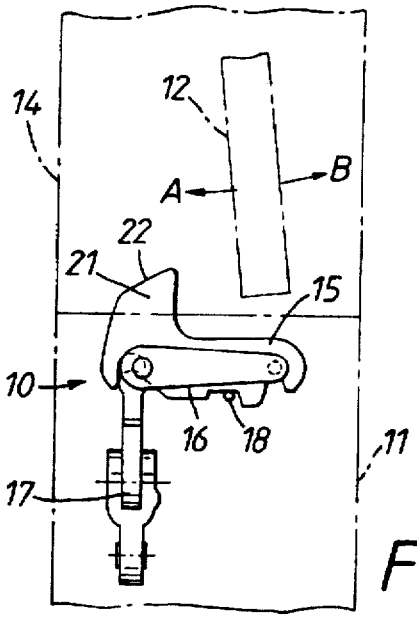
Figure 10:
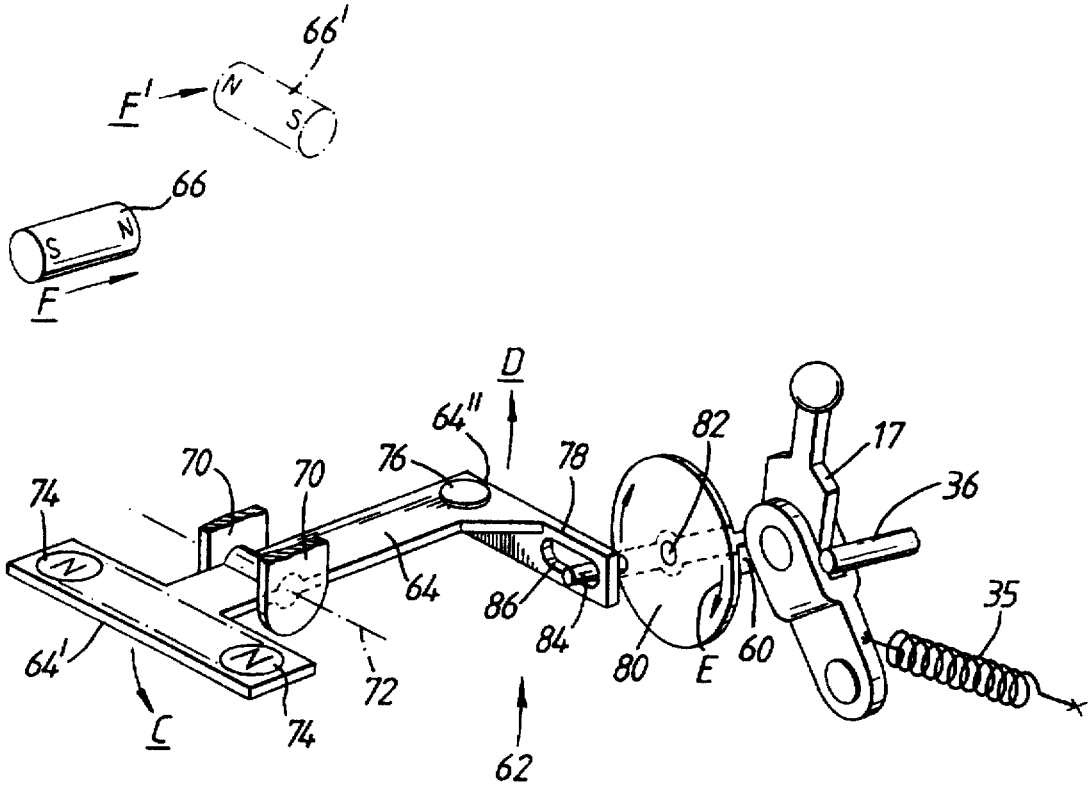

FIG. 3 schematically illustrates part of a pet door fitted with a latch mechanism according to this invention, the mechanism being shown from one side in exploded illustration;

FIG. 4 illustrates the mechanism per se as seen from above;

FIG. 5 shows the mechanism, as seen from the front, in a latching position;

FIG. 6 shows the mechanism, as seen from the side, in a door-releasing position;

FIG. 7 shows the mechanism in the door-releasing position, as seen from the front;

FIG. 8 shows the mechanism from the side, momentarily deflected by the moving pet door flap for resetting;

FIG. 9 shows the mechanism from the side, in its latching position to prevent inward movement of the pet door flap; and FIG. 10 illustrates a control means for the latch mechanism.

Figure 11:
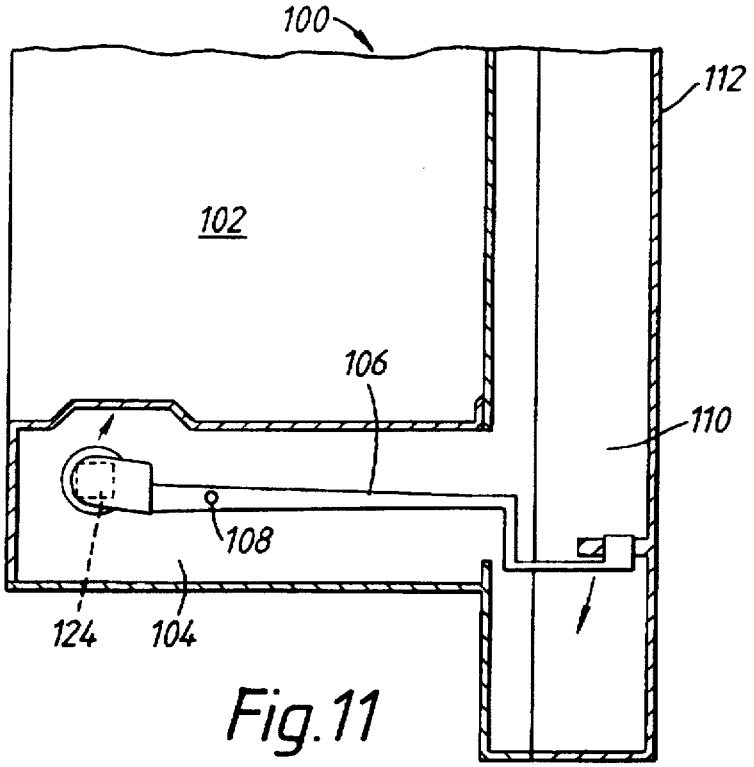
Figure 12:
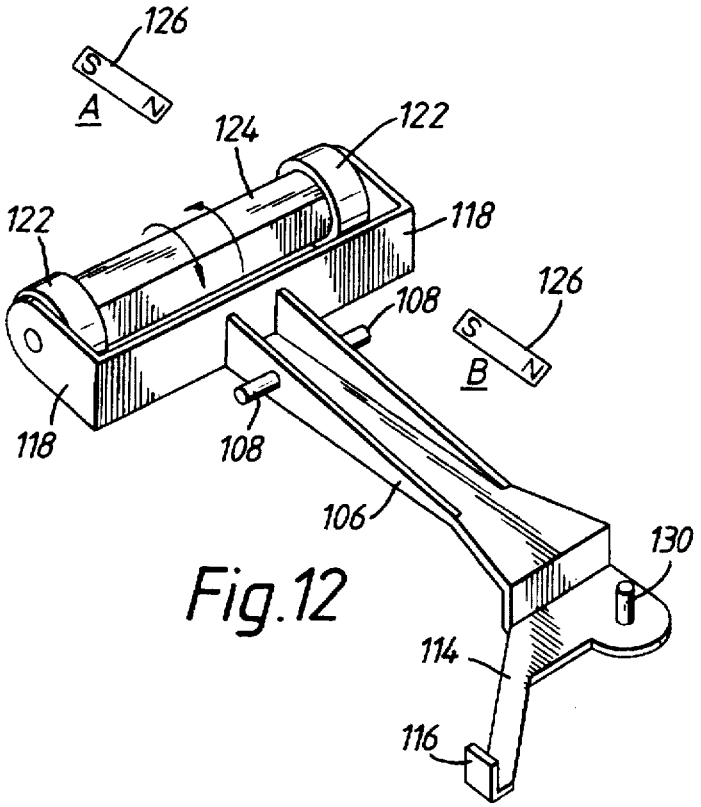
Figure 12A:
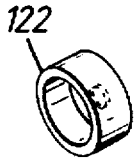
Figure 12B:
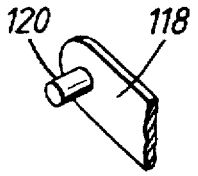

The present invention, on the other hand, is illustrated by way of example with reference to FIGS. 11 and 12 in which:

FIG. 11 is a part-sectioned fragmentary view of a bottom portion of a pet door embodying this invention;

FIG. 12 is a perspective view of a see-saw lever embodied in the pet door of FIG 11;

FIG. **12*a*** is detailed view of a pivot end cap; and

FIG. **12*b*** is a fragmentary detailed view of a pivot.

This prior arrangement will now be described. The pet doors thus constructed and arranged can allow animals ready egress from the building, but bar entry to unwanted animals such as strays, neighbours' pets and so on. Animals permitted entry are furnished with a collar bearing a key magnet. When the key magnet is appropriately juxtaposed with the pet door, it actuates a latch control means enabling the animal to disengage the latch from the pet door flap when pushing the flap aside to enter the building. The latch could, if desired, be designed to hold the flap against opening both inwards and outwards.

Figure 1:
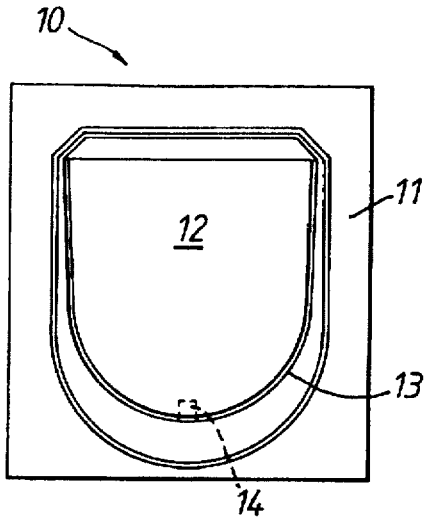
FIG. 1 is an elevation of a pet door embodying the invention.
Figure 2:
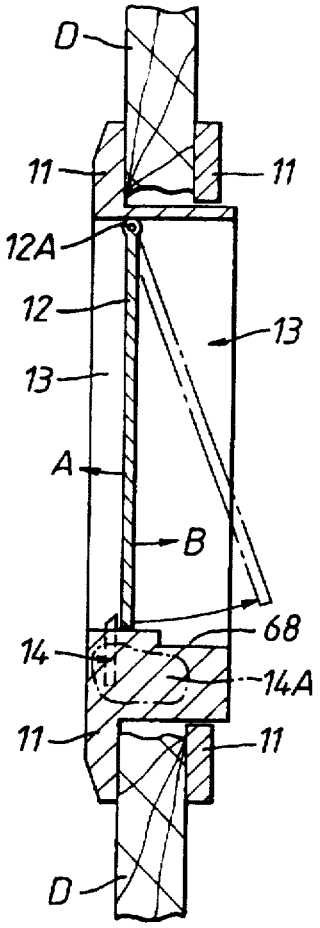
FIG. 2 is a longitudinal cross section through the pet door, shown fitted to a building door.

Referring now to the drawings, the pet door 10 comprises a door frame 11 and a top-hung door flap 12 capable of swinging within the door opening 13. The door flap 12 can be swung in either direction about its top hinge axis 12A to allow a pet to pass through the door opening. However, a latch mechanism 14 normally prevents movement of the flap in one direction, A in FIG. 2. When installed e.g in a door D of a building, direction A will usually be the inward opening direction. Although inward opening is normally barred, the latch mechanism 10 does not hinder opening in the opposite direction B, so pets will have ready egress from the building. As will be described, the latch mechanism 14 can be controlled to enable a pet to push the door flap 12 from engagement with the mechanism 14 and enter the building.

The latch mechanism 14 is contained in a housing 14A in the base of the frame 11. The mechanism itself comprises three principal components. They are: a movable catch 15, a support rocker or cradle 16 and a collapsible support strut 17. This mechanism is disclosed in GB 2 141 479.

The catch 15 comprises an arm 20 having an upstanding projection 21 at one end normally projecting through an aperture of the housing 14A to engage an edge (for instance the bottom edge) of the flap 12 and prevent inward opening movement in direction A. The upstanding projection 21 has a top or ramp surface 22 inclined to its door-engaging face, for a reason to be explained hereafter. Beneath the upstanding projection 21 is a recess 24 in the arm 20; this is to receive the head 25 of the collapsible strut 17. In the normal, latching condition of the mechanism 14, the strut 17 holds the arm 20 in a position such that projection 21 of the catch 15 is raised to prevent opening movement of the flap 12 in direction A. At the opposite end of the arm 20 is recess 26, which is a cylindrical hollow having an inwardly-tapering entrance. Recess 24 has a similar form. Recess 26 permits the catch 15 to form a snap fit with a pivot pin portion of the cradle 16. Intermediate the recesses 24, 26 is means to receive and retain a biasing spring 18, shown as a comparatively shallow recess.

The cradle 16 has two spaced-apart legs 28 interconnected at one end of the cradle by the pivot pin portion 29. The catch 15 is received between the legs 28, with its recess 26 pivotally engaged on pin portion 29. Oppositely-directed, aligned stub shafts 30 are provided on the legs 28, adjacent their free ends remote from pivot pin portion 29. The stub shafts 30 engage in journals (not shown) suitably provided in the door frame 11. The cradle is therefore mounted to rock about an axis through the stub shafts 30, this axis being parallel to the pin portion 29 on which the catch 15 pivots in the cradle. The stub shaft axis is closely adjacent the recess 24 seating the head 25 of the strut 17.

The collapsible strut 17 is a toggle linkage. As is conventional therefore, the toggle strut 17 has two links 17', 17" pivotally-interconnected at axis 32. One link 17' terminates in the head 25 which seats in the recess 24 of the catch 15. The other link 17" is apertured at 33 for pivotal mounting to the door frame 11. The pivot axes at 32, 33 are mutually parallel. A tension spring 35 extends between an attachment point on link 17" and a fixed anchorage in the frame 11. The spring 35 biases the toggle strut 17 toward a fixed abutment 36 on the door frame 11.

A second, displaceable abutment 60 is provided by this invention, and is part of the latch control means.

The abutment 60 is normally disposed adjacent the interconnection between the links 17', 17", as shown in FIG. 5. It is displaceable from this position, however, when a key magnet is operatively disposed at the pet door. In its normal, FIG. 5 position, abutment 60—together with abutment 36—prevents collapse of the strut 17. In this condition, the strut positively bars downward displacement of the catch 15 about the pivot pin portion 29 and consequential disengagement of upstanding portion 21 from the door flap edge. The strut 17 can be freed so as to collapse away from the abutment 36 and allow the latch mechanism 10 to yield to an inward opening force exerted on the door flap 12, by displacement of abutment 60 to the position shown in FIG. 7. Such displacement occurs when the key magnet is presented to the pet door.

The biasing spring 18 acts between the door frame, and the assembled catch 15 and cradle 16. It engages these assembled components 15, 16 at a location remote from the pivot axis through the stub shafts 30. The spring urges the pivot pin end of the cradle 16 upwardly about the said pivot axis, while affording the cradle an ability to pivot downwardly on its stub shafts 30. Yielding of the spring occurs when the door flap 12 is returning to its closed, FIGS. 3 and 5 position after the latch and flap have disengaged and the latter has been opened inwardly. The biasing spring could be a leaf spring or a compression spring, but in the preferred embodiment is a spring wire in the shape of a hairpin.

The latch control means will now be described with particular reference to FIG. 10. When activated (by a key magnet) the control means allows the strut 17 to be collapsed when pressure on door flap 12 is exerted in direction A. Such pressure is communicated to the upstanding latch portion 21 and has the effect of displacing it downwardly with accompanying collapse of the strut 17. In the result, portion 21 is displaced into the housing 14A momentarily, allowing the flap 14 to open in direction A.

The control means 62 comprises the displaceable abutment 60 and a rocking lever (or "see-saw" lever) 64 bearing one or more magnets to coact with the key magnet, 66 in FIG. 10. Lever 64 is located inside housing 14A, beneath a sill 68 of the pet door. It is mounted intermediate its ends on a low friction pivot between lugs 70 depending from the top of the housing 14A. The pivot axis 72 is horizontally disposed. At one end 64' the lever carries the magnet(s) 74. At the other end 64" the lever carries a counter-balancing weight 76. At this end, also, the lever 64 includes a crank 78 operatively interconnected with the displaceable abutment 60. The lever 64 is finely balanced so that it normally disposes the magnets closely beneath the sill 68 and the abutment 60 in position adjacent the fixed abutment 36 to prevent collapse of the strut 17.

Recognising that a small pet such as a kitten might not approach the pet door centrally, the lever is T-shaped, viewed in plan. It bears two, similarly-poled magnets 74. More preferably, it bears a single elongated magnet, as indicated in dotted lines in FIG. 10. The lever could be a simple straight beam bearing a single magnet, however, but would then be more sensitive to the positioning of the key magnet 66.

The illustrated displaceable abutment 60 is a blade projecting from one face of a disc 80 mounted to the door frame 11 via a low-friction rotational mounting 82. A pin 84 fast with and projecting from the disc 80 is loosely received in a slot 86 in the lever crank 78. The disc lies in a plane spaced from the strut 17, to avoid the disc itself interfering with the strut.

The disc 80 could be replaced, if desired, by a simple pivoted lever as indicated in dotted lines in FIG. 10.

The constituent parts of the control means 62 are so arranged and balanced that the displaceable abutment 60 is preferably just out of contact with the strut 17 when no key magnet 66 is presented to the pet door.

An appropriate key magnet 66 is of such polarity as to repel the magnet(s) 74 when it is presented to the pet door, e.g. is brought adjacent or into the confines of the door opening 13. When this repulsion occurs, and is of such a force as to exceed the small counterbalancing effect of weight 76, and frictional resistances, end 64' of lever 64 moves downwards (arrow C) and opposite end 64" moves upwards (arrow D). Thanks to the pin and slot connection 84, 86 between the crank 78 and the disc 80, the latter is rotated about its pivot mounting 82. The abutment blade 60 is thereby displaced (in the direction of arrow E) away from its normal operative juxtaposition with the strut 17. While the abutment 60 is so displaced, the strut 17 can be collapsed as a result of force exerted on latch portion 21 by a pet pushing on the flap. FIGS. 6 and 7 show the latch mechanism in its condition corresponding to release of the flap for inward opening.

By careful attention to design and engineering, only weak repulsive forces, or weak magnets, suffice to activate the control means to allow the latch mechanism to assume the release condition.

When the key magnet 66 is moved away from the see-saw magnet(s) 74, (as by the pet passing through the pet door) ultimately the magnetic repulsion force no longer exceeds the counter-balancing force provided by weight 76. The weight can then cause the lever 64 to pivot back to its previous or normal position. End 64" and the crank 78 will swing down, rotating the disc 80 counter to direction E and returning the abutment 60 to its normal position in which it blocks collapse of the strut 17.

It will be observed from FIGS. 3 and 9 that an animal may push the door flap 12 open from inside the building (in direction B) without difficulty. The catch 15 does not hinder such outward opening because the door flap 12 swings away from upstanding portion 21. This portion 21 blocks inward opening movement of the flap 12 (in direction A), however, should an unwanted animal endeavour to enter the building. The flap 12 cannot over-ride the catch 15 by any force, within practical limits, exerted thereon. This is because the strut 17, being biased against the abutment 36, holds the catch in its normally raised position. The underneath support the strut 17 gives the catch is applied thereto at a point spaced from the pivot pin portion 29. Thus, the catch 15 is rendered incapable of swinging downwards by pivoting on the said portion 29. It is mechanically impossible for force exerted in direction A on the flap to pivot the assembled catch 15 and cradle 16 about the axis of shafts 30 so as to release the flap for inward opening movement.

Suppose now that a key-bearing animal wishing to enter the building approaches the door. The presence of the key will deflect or repel the see-saw lever 64 thereby displacing the abutment 60 away from the strut 17. The pet, pushing on the flap 12, is able to cause the flap to over-ride the catch thanks to the strut 17 now being freed to collapse, as described above. As the strut 17 is collapsed, spring 35 is stretched, as will be appreciated. Once the flap slips clear of the displaced catch, the spring 35 will relax and erect the collapsed strut 17, biasing it against the fixed abutment 36. The catch will be returned to its normal, raised position at the same time, i.e. is reset. As the pet moves through the door 10, moving the key magnet away from the vicinity of the lever magnet(s) 74, the abutment 60 will return to its original position as described earlier.

Suppose now that an animal entering the building has just cleared the door. The flap 12 then swings back in direction B towards its closed position of its own accord. As it swings, the flap edge 48 encounters the upstanding portion 21 of the raised catch 15. For the latch mechanism to lock the flap once more against entry of unwanted animals, the flap must pass the catch 15 to assume the catch-engaging position shown in FIGS. 3 and 9. To make this possible, the catch is designed to be cammed downwardly away from the moving flap edge. The camming action results from coaction of the ramped surface 22 with the moving flap 12, and rocking of the cradle 16. The catch is downwardly displaceable due to the camming action despite the strut 17 being erect and braced against the abutment 36. FIG. 8 shows the manner is which the catch is displaceable.

As shown, the strut 17 prevents displacement of catch 15 about pivot pin portion 29. Instead, the catch 15 is momentarily displaced jointly with the cradle 16 by the flap. The assembled catch and cradle rock downwardly thanks to the pivotal attachment of the cradle 16 to the door frame through its stub shafts 30. This displacement is against the bias of spring 18. Once the flap (swinging in direction B) has encountered, displaced and passed the catch 15, the spring 18 will thrust the catch and cradle assembly upwardly about the stub shaft axis. The catch 15 is thereby raised and returned once again to its normal position, when it will prevent inward opening of the flap until such time as key magnet 66 is brought into operative juxtaposition with the lever magnet(s) 74.

The latch mechanism 10 described above has a very positive action. Before the key magnet 66 repels lever magnet(s) 74, the flap 12 is entirely secure against inward opening, no force exerted thereon being effective to override the catch 15. No significant force is needed however to displace the flap past the catch when the key magnet 66 is operatively placed at the door. Should a key-bearing animal approach the door, decide against entering the building and then move away from the door, the latch mechanism will remain active in barring inward opening of the flap.

In principle, the catch 15 could possess two upstanding portions suitably spaced apart to receive the flap therebetween. With such an arrangement, the latch mechanism 10 could lock the door against opening in either direction in the absence of the key magnet.

The force needed for displacing the abutment 60 is extremely small. The abutment and disc may together only weigh some 1.5 g and it is easy to make the rotational bearing 82 virtually frictionless. Thanks also to the fine balancing of lever 64 and its substantially frictionless pivot mounting, even weak repulsive magnetic forces between the key magnet and the lever magnet(s) will suffice to displace the abutment (60) from its FIG. 5 to its FIG. 7 position. This means that the magnets 66, 74 need not be made strong, large or of costly materials, and adequate range is obtainable from readily available magnets.

As shown in FIG. 10, the or each magnet 74 is so poled that the upper face thereof is a north pole. The unseen lower face(s) will, of course, be south pole(s). The key magnet 66 is so mounted on a pet collar that, as the pet approaches the door, its north pole is leading (arrow F) so as to repel the magnet(s) 74 and thereby rock the lever 64. By reversing the polarity of the magnets 66, 74, a very modest degree of selectivity could be obtained. That is, two "key differs" are available. Conceivably, two further differs might be obtained. Thus, for instance, if the lever 64 carries two magnets 74, the upwardly facing poles thereof could differ (one north and the other south). A key magnet disposed as indicated in dotted lines at 66' could effect the required repulsion of the lever magnets if moved towards the door 10 in direction F'. The effective range may not be as good with such an arrangement, however, and it would be more prone to non-release should a pet fail to position itself centrally of the door 10.

The arrangement depicted in FIGS. 1 to 10 and described above is entirely functional. However, it does have some practical drawbacks which the present invention seeks to tackle. The root of the drawbacks lies in the limited effective range of magnetically-releasable latch control means. To a degree, the range may be increased by using a more powerful key magnet and a more powerful see-saw lever magnet (s) 74. Cost, and weight, have to be considered though.

A commercial pet door embodying the arrangement of FIGS. 1 to 10 presents a tunnel several inches (e.g. 75–100 mm) long through which the pet passes. The latch and its control means including the see-saw lever 64 are contained in a compartment forming the base of the tunnel. The said lever 64 extends away from the flap 12 and its magnet(s) 74 are disposed an appreciable distance away from the flap.

A cat of average size bearing a collar magnet 66 as shown in FIG. 10 can indeed successfully pass through the pet door. The see-saw lever 64 will be displaced by magnet 66, readying the latch for releasing the flap, when the magnet is still some 1½ (38 mm) away from the magnet(s) 74. As the cat moves closer to the flap, the lever 64 will remain displaced so long as the magnets 66, 74 are "in range". In practice, the cat's nose will engage the flap and push it open, clearing the catch, while the key magnet maintains the lever in the latch-releasing displaced condition.

This, unfortunately, may not be the situation in the case of a small kitten. The distance between nose and neck (or, more accurately, between nose and collar magnet) may be relatively small. Then, it may happen that in its approach to the flap the lever is initially displaced by the interaction between the magnets 66 and 74. However, by the time the kitten's nose engages the flap, the collar magnet may be "out of range", when the hitherto displaced lever will have returned to a latch-securing position. When the kitten now attempts to nose the flap aside, it will be frustrated and the flap will not open. This, whilst being a problem, is not insuperable. For example, the kitten could in principle learn—or be taught—to push the flap open by extending a paw rather than using its nose.

Yet again, this problem experienced by a small kitten could be overcome by a differently-magnetised key magnet. Instead of a magnet poled as shown at 66 in FIG. 10, a flat planar magnet magnetised from top to bottom could be adopted. In such an alternative magnet, a the top surface would be e.g. a N pole while the bottom surface is e.g. a S pole, or vice versa. It is found that use of such a magnet effectively shifts the lever-displacing range closer to the flap as compared to a key magnet as depicted at 66 in FIG. 10.

The alternatively-poled key magnet has proved a practical solution for the smaller animal: with it, the lever remains displaced when the kitten's nose engages the flap.

At first sight, then, the problem appears and indeed is surmountable.

Surprisingly, we have experienced a further problem: customer resistance. Purchasers of our pet doors constructed as thus far described and illustrated in FIGS. 1 to 10 have been "testing" them and, wrongly perceiving the pet doors to fail, have been returning them for refunds. What such purchasers do is to hold a collar magnet between fingers and thumb and to move it towards the flap. When the extended fingers and thumb carry the collar magnet through the effective range of the lever magnet, the latter will be displaced as normal, but this will not necessarily be perceived by the purchaser. By the time the extended fingers touch the flap, the collar magnet, now adjacent the flap, will be out of range and the lever will have returned to the latch-securing position. The customer thus cannot push the flap open, and mistakenly believes the pet door is defective. In fact it is not and when worn by a cat as intended, the collar magnet will be properly located to displace the lever when the cat's nose pushes against the flap. Customers do not appreciate this, unfortunately.

We have therefore been looking for a solution to the foregoing problems. Surprisingly, the effective range can be extended to, or almost to, the flap by a very simple expedient. As a result, a pet door suiting kittens and mature cats has been developed, and this can be "tested" by customers without giving them a false notion that the system is inoperative.

The solution involves fitting to the see-saw lever a bar magnet which is mounted to rotate freely about its lengthwise axis. Thanks to its ability to rotate, it can efficiently align itself with the field of the collar magnet while the pet moves towards the flap. The end result is a greatly extended range of activation. This will be explained in more detail hereafter.

The present invention will now be described by way of example with reference to FIGS. 11 and 12 of the accompanying drawings.

The pet door 100 embodying this invention has a tunnel portion 102 through which a pet passes as it approaches the flap (not shown, but located adjacent the right hand side of the door 100 as shown in FIG. 11).

Beneath the tunnel 102 is a compartment 104 in which the see-saw lever 106 is located. It is freely rockable about a pivot 108. The lever 106 extends into a hollow part 110 of the pet door frame 112 in which the flap is hung. In the hollow part 110 the latch mechanism is contained. It comprises a movable catch, a support rocker or cradle and a collapsible support strut, all as described hereinbefore.

The lever 106 replaces lever 64 shown in FIG. 10. Incidentally, end 114 of the lever has been changed to form a stop 116 engageable with the collapsible support strut, and the rotatable disk 80 previously employed is omitted.

The lever 106 has a bifurcated yoke portion 118. Two opposed, inwardly-directed pivot pins 120 are provided on the yoke 118. These pins journal a pair of end caps 122 mounted at either end of a bar magnet 124, here shown as having a square cross-section. The magnet 124 is poled such that one face is an N pole and the opposite face is an S pole. The magnet 124 may form a tight interference fit with the end caps 122, or it may be cemented into them. Thanks to the end caps being journalled freely on the pivot pins 120, the magnet can spin on its longitudinal axis.

The magnet 124, and indeed the collar magnet, can be made of sintered neodymium/iron/boron alloy, although the invention is by no means limited to such a magnetic material.

In use, a cat will carry the collar magnet 126 towards the tunnel 102, approaching from the left as viewed in FIG. 11. As the collar magnet 126 comes in range of magnet 124, at A in FIG. 12, the latter will revolve. Thus, if the collar magnet is N pole leading, as shown in FIG. 12, the magnet 124 will rotate bringing its S pole face into confrontation with the collar magnet 126. The mutual attractive force between the magnets 124, 126 will be maximised thanks to the rotational mounting of lever magnet 124. As the cat continues its onward passage, the attraction between the magnets will lift the bifurcated end of the lever 106. This will displace the end stop 116 away from the collapsible strut, permitting the catch to be disengageable from the flap.

During its continued movement, the cat will carry the collar magnet 126 beyond the lever magnet 124 to position B. As the collar magnet 126 passes over magnet 124 the magnet 124 will constantly align itself with the magnetic field of the collar magnet 126 by freely rotating. This maintains a constant attraction, and in fact the lever 106 can remain in its lifted position even when the collar magnet is at or closely adjacent the flap. The problem of unwarranted rejection of pet doors by customers is thus overcome. Moreover, the pet door will be fully useable by mature cats as well as tiny kittens. Thanks to the rotational mounting of lever magnet 124 and its ability to rotate, the effective range of this embodiment is about double the range of the prior arrangement shown in FIG. 10.

Finally, it will be observed that the lever 106 has an upstanding post remote from the pivot 108 at lever end 114.

Balancing weights or washers will be affixed to the post. They will be chosen so as to maximise the sensitivity of the mechanism to the collar magnet. They will not entirely counterbalance the lever magnet 124, however, since it is required that the bifurcated, magnet mounting yoke end of the lever 106 be heavier than end 114. This is to ensure that the lever will of its own accord adopt a latch-securing position with the end stop 116 presented to the collapsible strut when no collar magnet is in the vicinity of the tunnel 102.

The present pet door 100 and the mechanisms therein are as before, save for the different lever 106, the rotatably-mounted magnet 124 and the omission of disk 80. In fact, whilst it is now preferred to omit the disk 80, the lever 106 could still coact with such a disk, as in the previous arrangement described in connection with FIG. 10.

We claim:

1. A pet door with a frame defining an access aperture and an aperture-closing flap pivotally mounted therein, wherein the pet door has latch means to bar the flap from opening in at least one direction and control means for disabling the latch means to permit the flap to open in said direction, the latch means comprising a catch and a collapsible support normally arranged to maintain the catch in a flap-barring position, and the control means being magnetically-responsive and operable, when a magnetic key means is operatively juxtaposed with the pet door, to allow the support to collapse and enable the catch to be moved from the flap-barring position to permit the flap to open in said direction, characterised in that the control means include an elongate magnet mounted to rotate freely about its major axis.

2. A pet door according to claim 1, wherein the latch means and control means are located within a housing in the frame, and the catch means is movable in an opening therefor in the frame from a flap-barring position projecting into the access aperture to a retracted position permitting the flap to open in said direction.

3. A pet door according to claim 2, wherein a thrust exerted on the flap in said direction is operative to displace the catch and collapse the collapsible support when the control means has been activated by the magnetic key means.

4. A pet door according to claim 2, wherein the collapsible support is a toggle-joint spring-biased against one of a first and second adjacent abutment and maintained thereby in an erect, catch-supporting position, the second abutment being displaceable from the toggle-joint, to allow same to collapse away from the first abutment, upon activation of the magnetically-responsive control means.

5. A pet door according to claim 4, wherein the second abutment is carried by a pivotable member mounted on a substantially frictionless pivotal mounting, the pivotable member being mechanically coupled to the control means.

6. A pet door according to claim 4, wherein the toggle joint has a pair of pivotally-interconnected links, one of which is coupled to the catch and the other of which is attached to a pivot mounting on the frame, and a spring tensioned between an attachment point on one of the links, and an anchorage on the frame biases the toggle joint toward the said one abutment.

7. A pet door according to claim 2, wherein the control means comprises a rockable lever mounting the elongate magnet, the lever providing a stop engageable with the collapsible support to prevent collapse thereof, and the lever being displaceable so as to disengage the stop from the collapsible support thereby allowing the latter to be collapsed, in response to interaction between the elongate magnet and the keys means.

8. A pet door according to claim 7, wherein the lever is mounted on a substantially frictionless pivot, and the elongate magnet is pivoted substantially frictionlessly to an end of the lever remote from the collapsible support.

9. A pet door according to claim 1, wherein the collapsible support is spring-biased to a non-collapsed state for maintaining the catch in the flap-barring position, and said control means are arranged to block collapse of the collapsible support until said control means are activated by the magnetic key means.

10. A pet door according to claim 1, wherein the elongate magnet is a square-section bar magnet magnetised so that its N and S poles are along opposite sides of the bar.

11. A pet door according to claim 1, wherein the catch is pivotally mounted, remote from the collapsible member, on a rockable support element which mounts said catch adjacent one end thereof, the support element being mounted to rock with the catch about an axis adjacent its other end and adjacent the collapsible member, the arrangement in use permitting the catch to be displaced out of the path of movement of the flap as the flap swings back to a closed position after being opened in the said one direction.

12. A pet door according to claim 11, further including spring means biasing the catch and support element in a direction opposite that in which the catch is displaced by the swinging flap.

13. A pet door with a frame defining an access aperture and an aperture-closing flap pivotally mounted therein, wherein the pet door has latch means to bar the flap from opening in at least one direction and control means for disabling the latch means to permit the flap to open in said direction, the latch means comprising a catch and a collapsible support normally arranged to maintain the catch in a flap-barring position, and the control means being magnetically-responsive and operable to allow the support to collapse and enable the catch to be moved from the flap-barring position to permit the flap to open in said direction, characterised in that the control means include an elongate magnet mounted to rotate freely about its major axis.

14. A pet door according to claim 13, further comprising a magnetic key means fastened to a pet collar that is configured to cause said control means to allow the support to collapse.

* * * * *